US006964117B2

(12) United States Patent
Parent

(10) Patent No.: US 6,964,117 B2
(45) Date of Patent: Nov. 15, 2005

(54) METHOD AND APPARATUS FOR ADJUSTING A MOISTURE PROFILE IN A WEB

(75) Inventor: Laurent R. Parent, Westbrook, ME (US)

(73) Assignee: Metso Paper USA, Inc., Biddeford, ME (US)

( * ) Notice: Subject to any disclaimer, the term of this patent is extended or adjusted under 35 U.S.C. 154(b) by 0 days.

(21) Appl. No.: 10/326,360

(22) Filed: Dec. 20, 2002

(65) Prior Publication Data

US 2004/0118009 A1 Jun. 24, 2004

(51) Int. Cl.[7] ..... F26B 13/10

(52) U.S. Cl. ..... 34/528; 34/353; 34/540; 34/546; 34/550; 34/553; 34/115; 34/119; 34/124; 34/132; 34/633; 34/636; 34/638

(58) Field of Search ..... 34/528, 535, 540, 34/543, 546, 549, 550, 553, 110, 114, 115, 34/119, 124, 130, 132, 618, 623, 629, 633, 34/636, 638, 419, 422, 425, 426, 444, 445, 34/446; 162/198, 207, 252; 101/424.1, 487

(56) References Cited

U.S. PATENT DOCUMENTS 3,167,408 A 1/1965 Justus et al.
3,303,576 A 2/1967 Sisson
4,247,990 A 2/1981 Ohls et al.
4,462,868 A 7/1984 Oubridge et al.
4,942,675 A 7/1990 Sundgvist
5,416,979 A 5/1995 Joiner
5,425,852 A 6/1995 Joiner
5,465,504 A 11/1995 Joiner
5,915,813 A 6/1999 Joiner
6,138,380 A 10/2000 Veijola et al.
6,154,981 A 12/2000 Heikkila et al.
6,210,268 B1 4/2001 Fleissner
6,314,659 B1 11/2001 Parker

FOREIGN PATENT DOCUMENTS

GB 2127871 A * 4/1984 ..... D21F 3/02

* cited by examiner

*Primary Examiner*—Jiping Lu
(74) *Attorney, Agent, or Firm*—Pierce Atwood; Kevin M. Farrell; Ryan B. Kennedy

(57) ABSTRACT

An apparatus for drying a travelling wet fibrous web is provided which comprises a rotating air-permeable drum. The drum is at least partially surrounded by a hood which has an interior space for receiving a flow of air and directing the flow of air through a permeable inner wall towards the outer surface of the drum. At least a portion of the hood is divided into individual sections in a cross-machine direction. Apparatus is provided for supplying a flow of drying air at a first temperature to the hood, and for supplying profiling air at a selected different temperature different from the first temperature to at least one of the individual sections.

17 Claims, 10 Drawing Sheets

METHOD AND APPARATUS FOR ADJUSTING A MOISTURE PROFILE IN A WEB

BACKGROUND OF THE INVENTION

This invention relates generally to dryers for permeable webs and more particularly to through-air drying systems.

In many web processing methods, such as paper making, through-air dryers (TADs) are used for evaporative drying of the web after, before or instead of pressing devices. Typically a through air drying unit includes a hollow rotatable drying roll having a permeable cylindrical drum around which a wet web is partially wrapped as the web is passed through the unit. The web is typically supported on a continuous fabric as it is passed through the drying unit. Heated air passes through the permeable drum face and through the web and fabric so as to cause evaporative drying of the web. For reasons of energy efficiency, the heated air may be recovered after it has passed through the web and a substantial portion of the recovered air recirculated back through a heating device where it is reheated and passed back through the porous roll face and the web and fabric.

In most drying processes it is desirable to uniformly dry the web. In a continuous sheet drying process such as paper drying this means that the sheet is to be dried to uniform dryness across its width. However, the web as it enters the drying process typically varies in moisture across its width. It is said to have a moisture "profile". That is, if the amount of moisture in the web were to be plotted against position across the web, the resulting graph would not be a horizontal line. The variations in the overall process which cause the moisture profile lead to variability in the final dryness of the product that should be corrected to improve efficiency, yield, and quality. Present methods to control or correct the product's moisture profile (referred to as "profiling") involve corrections to sheet moisture before the drying process and within the drying process for some types of drying processes.

One known method used to correct the moisture profile is to change the drying rate across the width of the web. This is done by changing the amount of drying air flow to individual sections across the width of the web. While this is a successful method with some types of drying equipment, such as Yankee dryers having a solid drum, this is not possible with a through-air dryer because the airflow must be substantially constant across the width of the web to ensure proper operation. Accordingly, there is a need for a through-air drying unit which allows control of the moisture profile across the width of a web.

BRIEF SUMMARY OF THE INVENTION

The above-mentioned need is met by the present invention, which provides a method and an apparatus for drying a travelling wet fibrous web. The apparatus comprises a rotating air-permeable drum. The drum is at least partially surrounded by a hood which has an interior space for receiving a flow of air and directing the flow of air through a permeable inner wall towards the outer surface of the drum. At least a portion of the hood is divided into individual sections in a cross-machine direction. Means are provided for supplying a flow of drying air at a first temperature to the hood, and for supplying profiling air at a selected temperature different from the first temperature to at least one of the individual sections.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
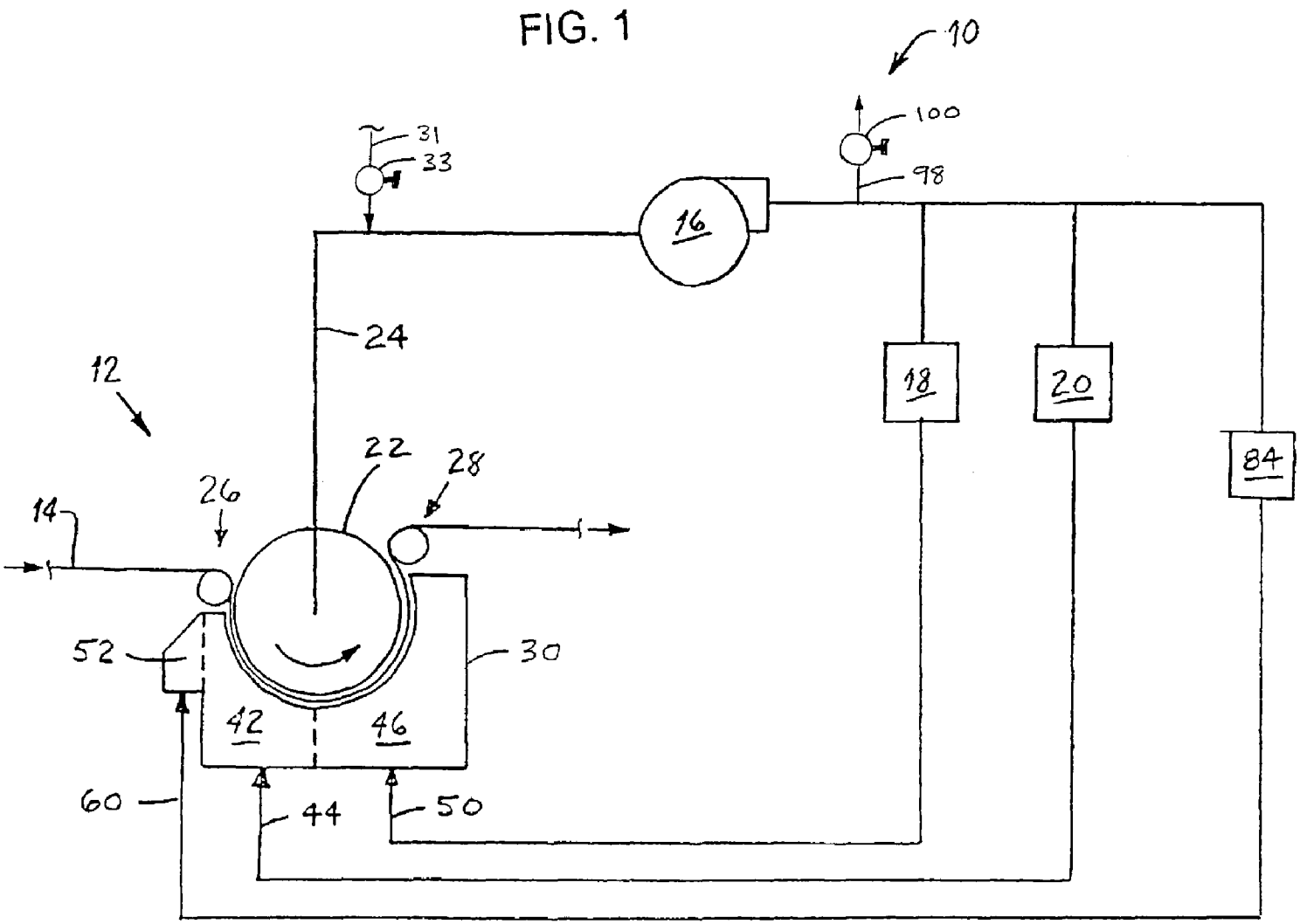
FIG. 1 is a schematic view of an exemplary overall through-air drying system.

Referring to the drawings wherein identical reference numerals denote the same elements throughout the various views, FIG. 1 is a schematic drawing of an exemplary through-air drying (TAD) system 10 constructed in accordance with the present invention. The overall system arrangement is typical of that used for drying paper products such as tissue and paper towel. However, the TAD system 10 may be used for drying any air-permeable web of material, including nonwoven materials and textiles. The basic components of the TAD system 10 are a dryer assembly 12 through which a web 14 passes, a pump 16 for moving air through the system, such as a fan or a blower, and one or more heaters 18 and 20 which are connected by suitable air ducting to form a closed loop as shown. The dryer assembly 12 is of a known type including a generally cylindrical, hollow drum 22 rotatably supported and provided with means for turning it such as an electric motor. The surface of the drum 22 is air-permeable and may be of various constructions such as perforated sheet metal, honeycomb, expanded metal, etc. The interior of the drum 22 is connected at its ends or through the face opposite a hood 30 (described below) to a suitable return duct 24, which is in turn connected to the intake end of the pump 16. The dryer assembly 12 has a "machine direction" which refers generally to the overall direction of the movement of the web 14 through the system 10 and would be from left to right in FIG. 1, for example. The dryer assembly 12 also has a "cross-machine direction" which refers to an axis perpendicular to the direction of movement through the system 10, which in the illustrated example is parallel to the axis of rotation of the drum 22. The portion of the dryer assembly 12 where the web 14 enters is generally referred to as its "wet end" 26, while the portion where the web exits is referred to as its "dry end" 28.

The drum 22 is partially surrounded by a hood 30 which supplies heated air to the exterior of the drum 22. The exemplary hood 30 shown in FIG. 1 surrounds approximately 200° of the circumference of the drum 22, although this angle may be increased or decreased as required for a particular application. The hood 30 is shown mounted below the drum 22. However, this position is of no special importance to the present invention and the hood 30 could be mounted in other positions with respect to the drum 122, for example above the drum 122 or to either side of it. The hood 30 is a hollow housing comprising an impermeable outer wall 32 and a permeable inner wall 34 (see FIG. 2). In operation, the moisture-laden web 14 enters the dryer assembly 12 at the wet end 26, passes around the rotating drum 22, and exits the dryer assembly 12 at the dry end 28. The web 14 may be self supporting, but for typical paper or tissue applications, it is supported by a permeable fabric of a known type which functions in a manner similar to a conveyor belt, or simply a sleeve of a known type installed over the drum. Heated air from one or more heaters 18 and 20 is supplied to the interior of the hood 30 through one or more air ducts 44 and 50. The term "heater" is used herein to refer to any device used primarily to increase the temperature of the air flowing through it. For example, the heater 18 may be a combustion heater which burns a fuel therein, or it may be a heat exchanger that transfers heat to the air flow from a flow of high-temperature fluid (such as an industrial steam supply). The heated air flows through the inner wall 34 and flows to the web 14. The air passes through the web 14 and into the interior of the drum 22, which is maintained at a slightly negative pressure by virtue of its fluid communication with the intake side of the pump 16. The air then returns through the return duct 24 to the pump 16 where the cycle repeats. The air flow ducting of the TAD system 10 includes a make-up air duct 31 controlled by a inlet valve 33, and a relief duct 98 vented outside the system 10 and controlled by an outlet valve 100. The make-up and relief ducts allow air to be added or removed from the TAD system 10 in order to maintain a constant airflow therethrough.

The web 14, which has been formed in a process upstream of the dryer assembly 12 (for example by deposition from a headbox of a known type) has a moisture profile in the cross-machine direction resulting form non-uniformities in the upstream process. In other words, if the amount of moisture in the web were to be plotted against position across the web 14, the resulting graph would not be a horizontal line.

The airflow supplied to the web 14 must be substantially constant in order to maintain a selected pressure difference across the web 14. If the supply flow is too high, excess heated air will escape out of the end clearances between the drum 22 and the hood 30. Conversely, if the supply flow is too low, then outside air will be drawn into the same spaces. Either condition detracts from the uniformity of the drying process and is undesirable. Furthermore, because of its connection to the intake end of the pump 16, there is always a negative pressure in the interior of the drum 22, and thus a pressure difference across the surface of the web 14, regardless of any changes in the supply air flow. Therefore, if the supply air flow were altered, for example lowered, in one cross-machine location, the air flow from the adjacent locations would be drawn in to that location. Conversely, if the air in one cross-machine location were increased, the air would be spread out to adjacent locations. Therefore, the drying effectiveness of the TAD system 10 cannot be controlled by simply varying the drying airflow across the width of the drum 22. Accordingly, in the present invention the temperature of the air flow in each of several individual cross-machine sections is varied to control the drying rate in that section, while the total airflow to each section is substantially constant.

Figure 2:
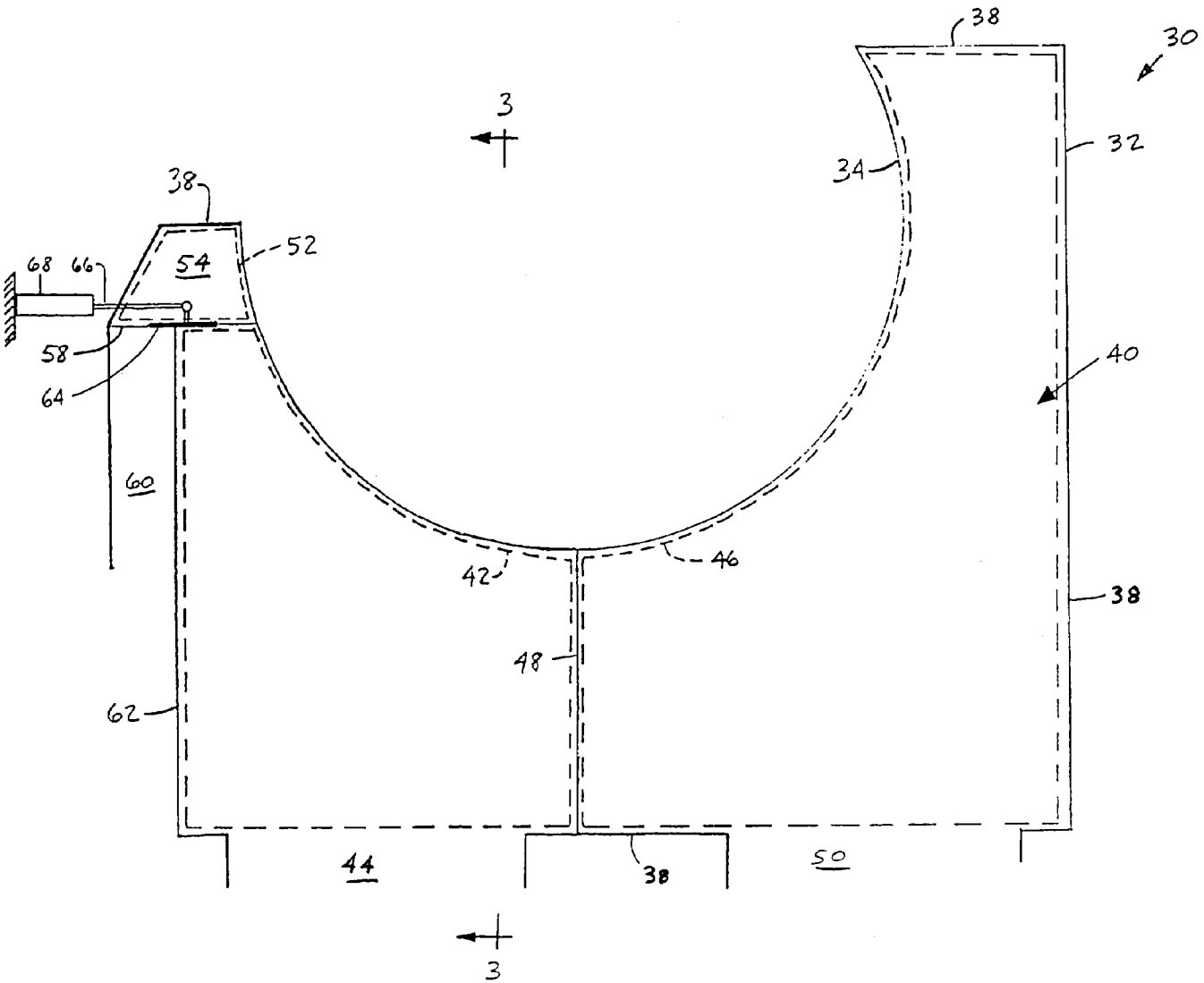
FIG. 2 is a schematic side view of a hood for use with the through-air drying system of FIG. 1.

FIG. 2 shows a schematic view of a hood 30 constructed in accordance with the present invention. The hood has an outer wall 32, which may comprise several individual panels 38 connected together. The outer wall 32 is constructed of an impermeable material, for example sheet metal. The outer wall is spaced away from a permeable inner wall 34, such as a sheet metal plate having a plurality of perforations formed therethrough. The space between the outer wall 32 and the inner wall 34 surrounds an interior space 40. The inner wall 34 is curved to form a partial cylinder which surrounds the drum 22 a small distance away from the surface of the drum 22.

A first drying zone 42 is defined in the interior space 40 of the hood 30. As shown in FIG. 1, the first drying zone 42 is part of an air flow circuit which starts at the pump 16, passes through a first heater 18, is delivered to the hood 30 through a first drying air duct 44, and then returns to the pump 16 by way of the return duct 24.

An additional drying zone 46 may also be defined in the interior space 40 of the hood 30. The additional drying zone 46 is adjacent to the first drying zone 42 and is separated from the first drying zone 42 by a divider 48. As shown in FIG. 1,the additional drying zone 46 is part of an air flow circuit which starts at the pump 16, passes through a second heater 20, is delivered to the hood 30 through a second drying air duct 50 to the hood 30, and then returns to the pump 16 by way of the return duct 24. The additional drying zone 46 allows the tailoring of the temperature in the machine direction in a known manner, so that the drying air provided to each zone more closely matches the desired drying rate in a particular location along the machine direction than if a single drying zone were used. In this case, two drying zones and their associated air flow circuits are shown, however, any desired number of drying zones may be implemented by dividing the interior space 40 of the hood 30 into additional zones and providing additional drying air flow circuits to supply drying air flow thereto.

Figure 3:
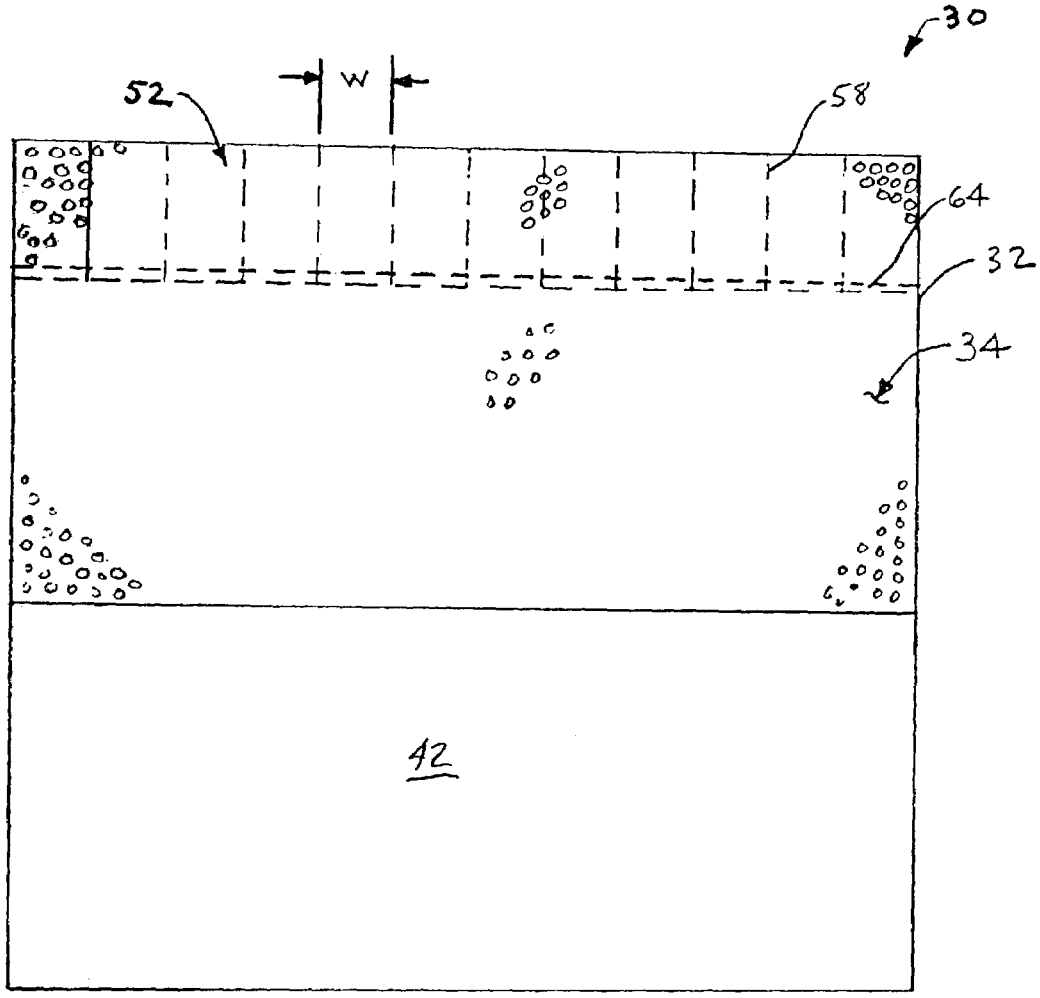
FIG. 3 is a view along lines 3—3 of the hood assembly of FIG. 2.

The hood 30 incorporates a profiling zone 52. The profiling zone 52 is defined by a selected portion of the inner wall 34 and the portion of the interior space 40 of the hood 30 immediately adjacent the selected portion of the inner wall 34. In the illustrated example the outlet area of the profiling zone 52 extends over approximately 15° of the inner wall 34, although this dimension may be altered to suit a particular application. for example, if the profile is such that the cross-machine variation in moisture is large, then a larger profiling zone may be used to obtain a greater ability to change the moisture profile. The profiling zone 52 is divided into individual sections 54 (only one of which is shown in FIG. 2) by a plurality of spaced-apart divider plates 58 disposed in the interior space 40 of the hood 30 across the width of the hood 30, as shown in FIG. 3. Unlike other profiling systems intended for solid-roll dryers, the individual sections 54 do not require individual return ducts and therefore may be made arbitrarily small, limited only by the size of any ducting needed to deliver air to them. For example, in a drum 22 having a width of approximately 3.04 m (10 ft.), the sections 54 may have a width W of approximately 15 cm (6 in.) This allows more precise control of the moisture profile of the web 14.

A supply of tempering air flow is supplied to the profiling zone 52 by a tempering air duct 60 (see FIG. 1). In the example illustrated in FIG. 2, one of the panels of the outer wall 32 forms a septum 62 which separates the tempering air duct 60 and the first drying zone of the hood 30. A plurality of moveable plates 64 (one of which is shown in FIG. 2) are disposed at the top of the septum 62. Each of the moveable plates 64 extends across the width of one of individual sections 54. The moveable plates 64 are able to slide between a first position wherein all of the air flow to the profiling zone 52 is supplied from the first drying zone 42 and no air from the tempering air duct 60 can reach the profiling zone 52 (i.e. all the way to the left in FIG. 2), and a second position wherein all of the air flow to the profiling zone 52 is supplied from the tempering air duct 60 and no air from the first drying zone 42 can reach the profiling zone 52 (i.e. all the way to the right in FIG. 2). The moveable plates 64 may be individually slid to any desired location between these two extreme positions to control the proportion of flows and therefore the temperature in each individual section 54 of the profiling zone 52. In the illustrated position the moveable plate 64 shown would allow approximately 50% tempering air flow and approximately 50% first drying air flow into the profiling zone. Because all of the supply ducts 44, 50, and 60 are connected to the same closed circuit (see FIG. 1), the total airflow remains constant.

In the illustrated example the moveable plate 64 is shown as being connected to the rod 66 of a hydraulic cylinder 68 which supplied with working fluid through a known arrangement of pumps and valves (not shown) in order to position the moveable plate 64. Any other appropriate actuator means may be used, such as electric linear motors, ball screw jacks, etc. The moveable plates 64 may also be set in the desired position manually.

The air mixing arrangement is not limited to the sliding plate arrangement depicted in FIG. 2. Any type of valving arrangement which allows control of the relative flows of tempering air and drying air into the profiling zone 52 may be used.

Figure 4:
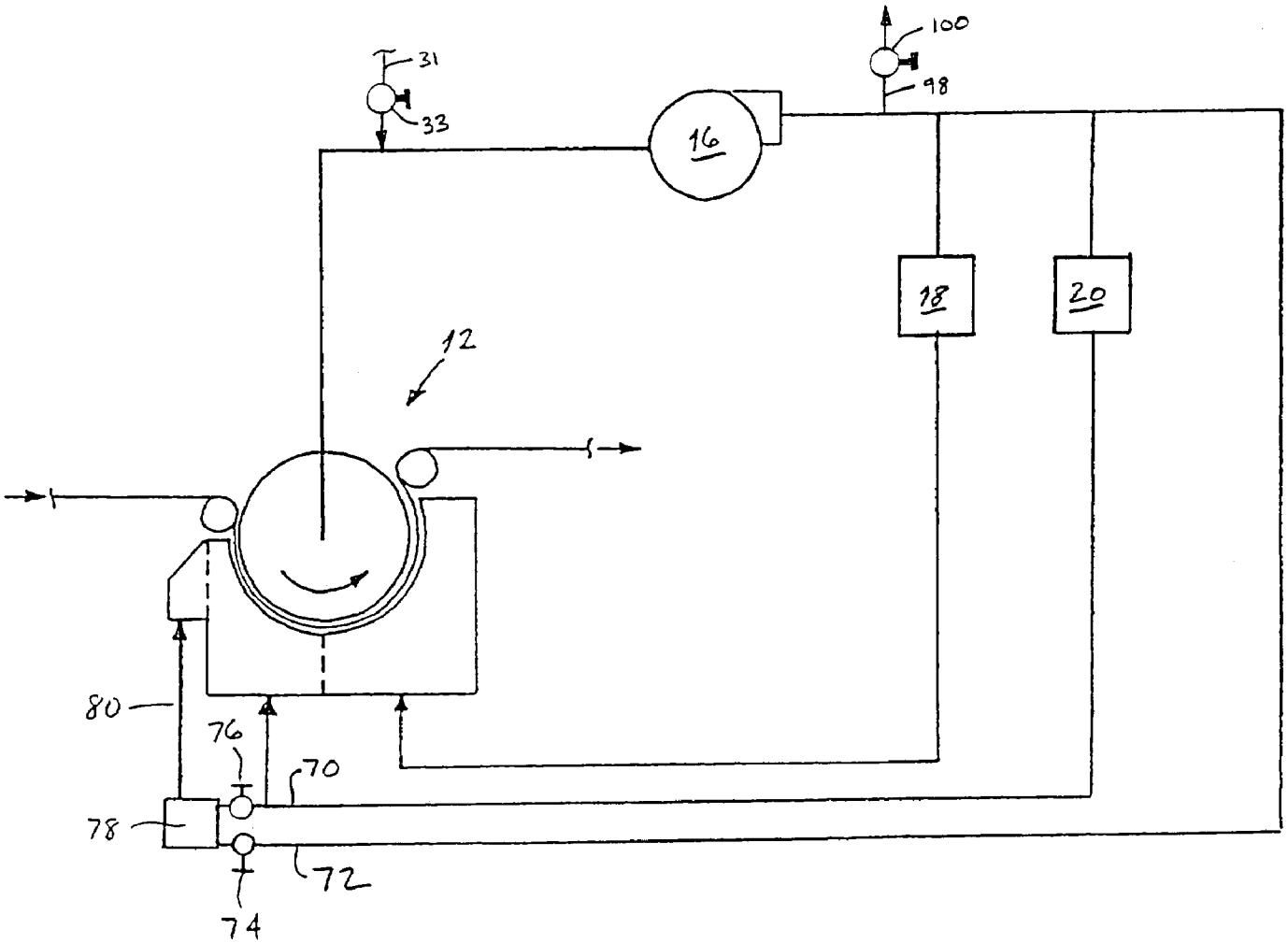
FIG. 4 is a schematic view of an air flow circuit for use with the through-air drying system of the present invention.
Figure 5:
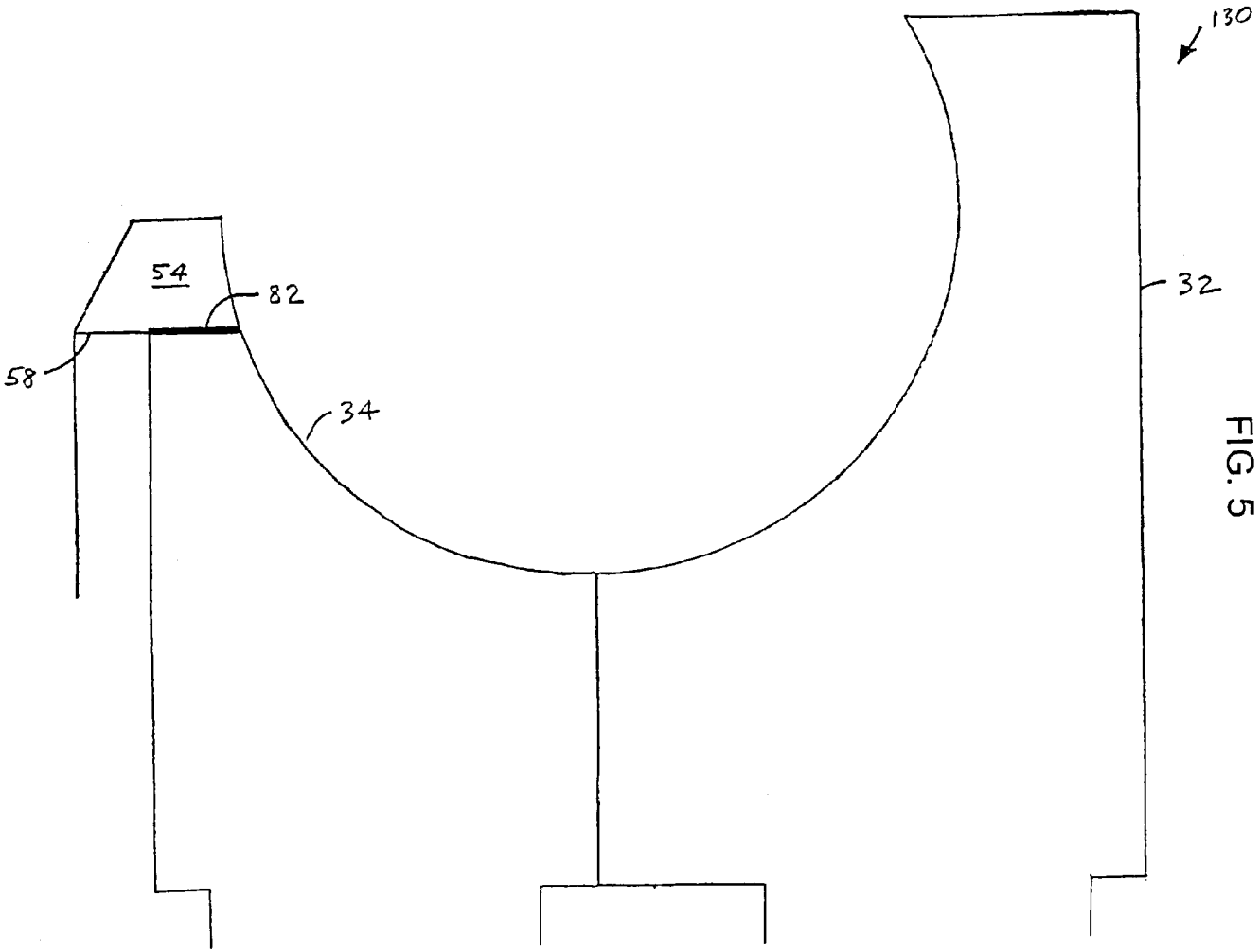
FIG. 5 is an end view of an alternative hood for use with the through-air drying system of FIG. 4.

Other methods of supplying air to the profiling zone 52 may also be used. For example, referring to FIG. 4, air flow from ducts 70 and 72 containing drying air and tempering air respectively could be metered by valves 74 and 76 into a mixing plenum 78 in the desired proportions before entering the hood and then transferred to a plurality of profiling ducts 80 (one of which is shown in FIG. 4) leading to the profiling zone 52. In this instance, a slightly different hood 130 would be used, shown in FIG. 5. In this case, the hood 130 lacks the moveable plates. The profiling zone 52 is completely isolated from the first drying zone 42 by a separator 82. All of the profiling air flow is supplied through the profiling air duct 80. This variation may simplify the construction of the hood 130, as it does not require the incorporation of moving parts inside the hood 130.

Figure 7:
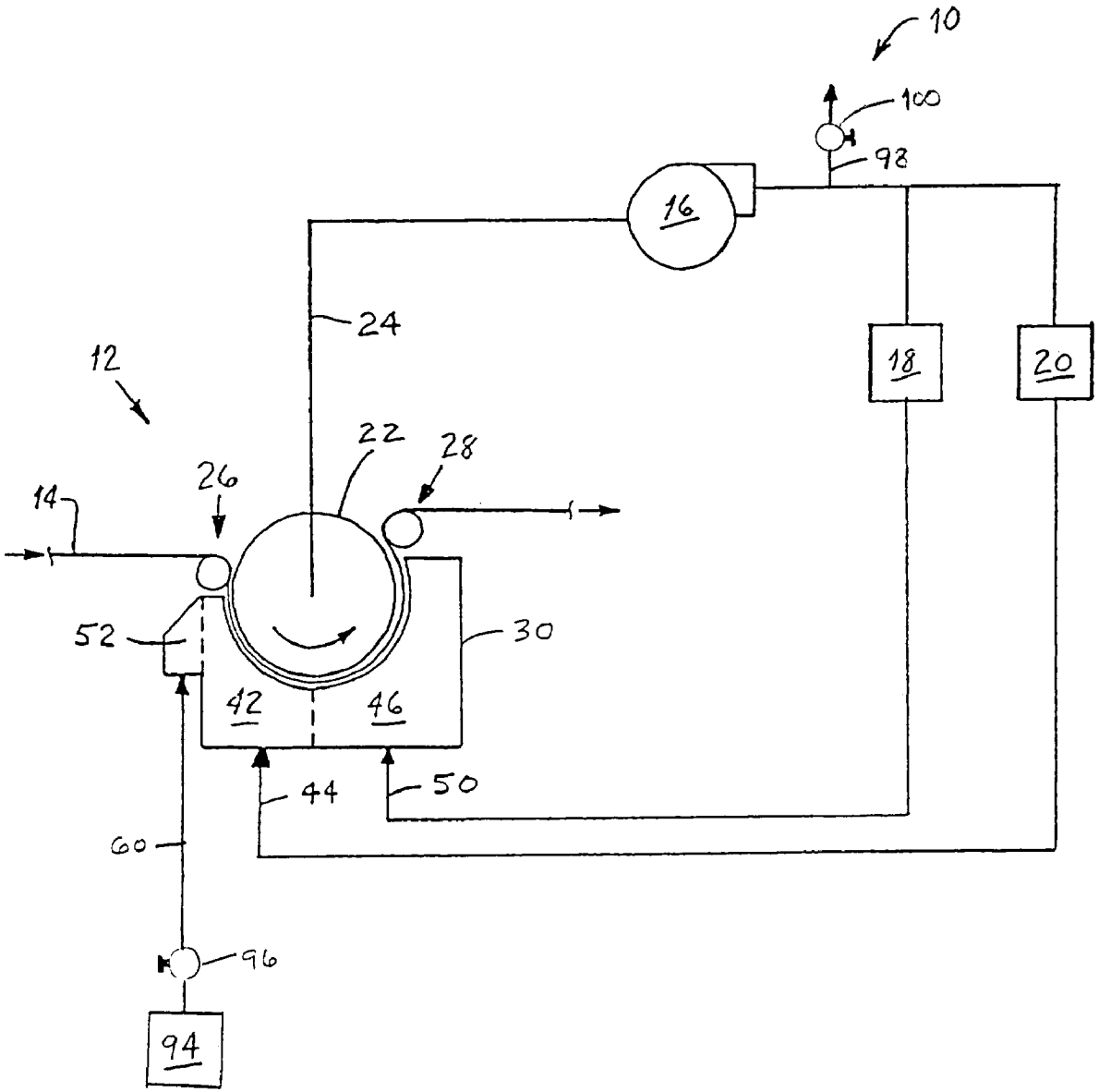
FIG. 7 is a schematic view of the through-air drying system of FIG. 1 incorporating an external tempering air source.

The particular embodiment described depicts the use of relatively cold return air which has not passed through the heaters 18 or 20 to supply the tempering air flow. It is also possible to change the drying rate in individual sections of the profiling zone 52 by using air which has been heated to a temperature greater than the drying air for tempering air. For example, an additional heater 84 (see FIG. 1) could be incorporated into the tempering air circuit. The tempering air could also be supplied by an external source. For example, FIG. 7 illustrates a configuration where the tempering air is provided from a tempering air source 94 to a tempering air duct 60 controlled by a inlet valve 96. The tempering air source 94 may be any apparatus capable of providing the required air flow at the desired temperature, for example a heater similar to those described above. In this case, the relief duct 98, vented outside the system 10 and controlled by the outlet valve 100, may be used to remove air from the system 10 to compensate for the introduction of the tempering air, in order to maintain a constant airflow through the TAD system 10.

The profiling zone 52 may be located at the wet end 26 of the dryer assembly 12, at the dry end 28, or at any desired location in between. Since a significant source of moisture non-uniformity in the finished product results from drying differences in the through air drying process whose root cause are non-uniformities in the input web 14, it is considered desirable to correct the profile where the non-uniformity is developed, i.e. at the wet end.

Figure 6:
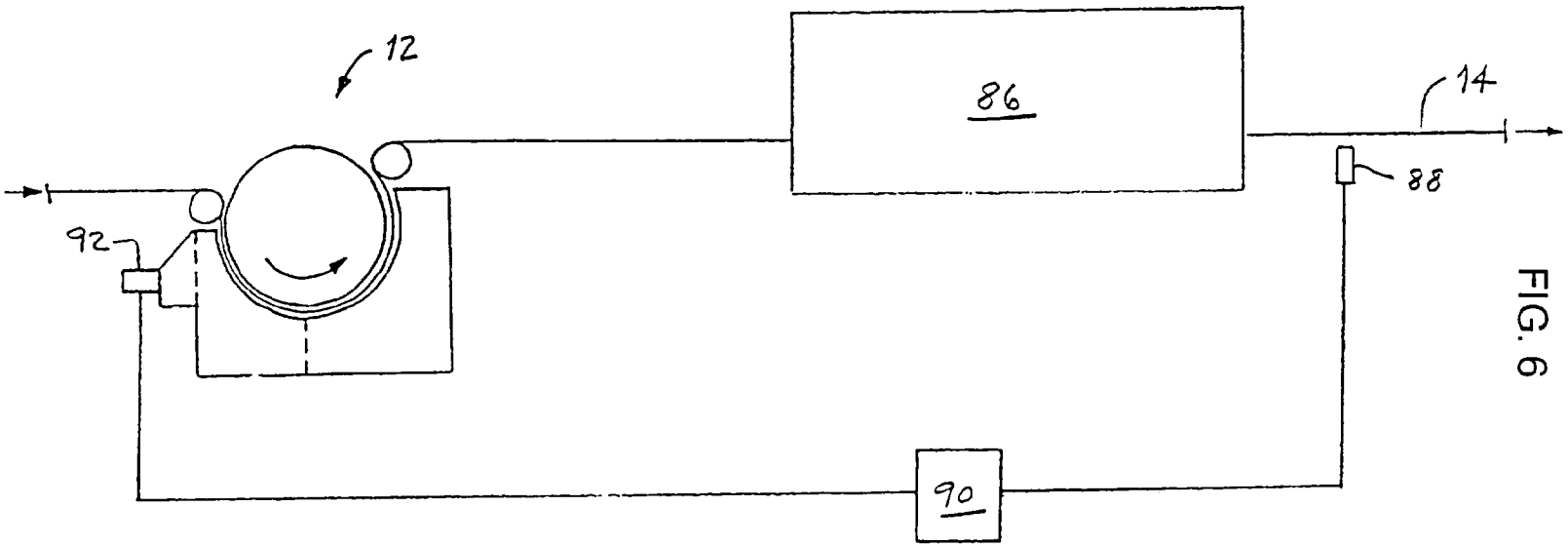
FIG. 6 is a schematic view of a variation of the through-air drying system of the present invention incorporating a feedback control loop.

As shown in FIG. 6, The equipment 86 downstream of the TAD system 10 (e.g., a portion of a paper making machine) is provided with a means for determining the cross-machine moisture profile of the finished product, for example an optical sensor 88 of a known type may be incorporated at the end of the paper making machine. Typically, the cross-machine moisture profile of the web 14 supplied to the dryer assembly 12 will be generally stable over time once the production line has been set up. Therefore, the present invention may be used by test running the overall paper making machine, determining any correction required to the moisture profile of the web 14, and then adjusting the tempering air flow in each cross-machine section 54 as needed to achieve uniform cross-machine moisture of the finished product. For example when using relatively cold drum return air for tempering, if a particular section is associated with a relatively "wet" portion of the moisture profile, then no tempering air will be supplied to that section and the drying rate will be left at the nominal rate, whereas if a particular section is associated with a relatively "dry" portion of the profile, then tempering air will be supplied to that section, mixing with the drying air, reducing the overall temperature in that section and decreasing the drying rate.

The following example illustrates how the correction described above may be carried out. Assume the following parameters: an overall drying angle (i.e. the portion of the drum 22 surrounded by the hood 30) of 248°, a profiling zone angle of 25° , a first drying zone temperature of 210° C. (410° F.), an average sheet basis weight 20 g/m$^2$ (12.3 lbs/3000 ft$^2$), a sheet ingoing solids content 25%, and a sheet outgoing solids content of 85%. It is noted that the term "basis weight" refers to the area density of dry matter in the web, and "percent solids" refers to the percentage weight of solid matter in a given unit mass of the web. For a constant percent solids value, the total solids content of the web 14 will be higher in an area having a higher basis weight. At a given cross-machine position, it is possible that the basis weight of the web 14 entering the TAD system 10, through process variations, could be 19.5 g/m$^2$ (0.58 oz/yd$^2$), or less than the average basis weight. Without profiling, this would result in an outgoing solids content of approximately 88% for this part of the web 14, because it would be subjected to the same drying rate as the rest of the web 14, and therefore a proportionally greater amount of moisture would be removed from the web 14 at this cross-machine position. However, by employing one of the profiling zones with a temperature of 169° C. (336° F.), the local drying rate may be reduced, allowing the outgoing solids content of this part of the web 14 to be equal to the average of 85%.

The system 10 could be manually adjusted to achieve the corrections described above. However, the system may also incorporate a feedback control system. For example, as shown in FIG. 6, the output of the moisture sensor 88 could be supplied to a computer 90 which would provide control signals to an actuator 92 (e.g. a motor or other servo device) that is connected to the moveable plates 64. The position of the plates 64 could then be continuously adjusted during the operation of the TAD system 10 to allow for variations in the moisture profile.

Figure 8:
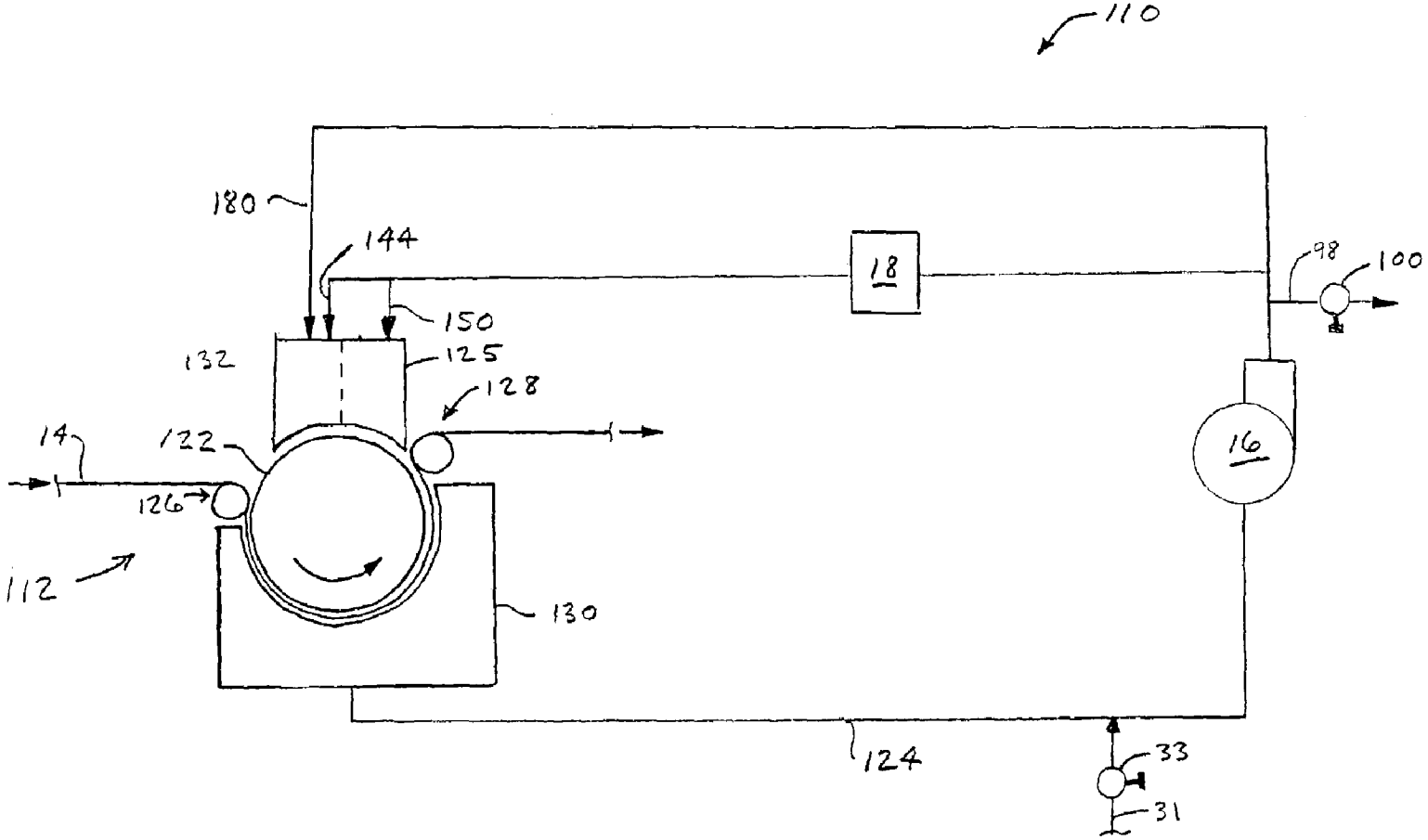
FIG. 8 is a schematic view of an alternative embodiment of the through-air drying system of the present invention

An alternate embodiment of the TAD system is illustrated in FIGS. 8, 9, 10, 11, and 12. FIG. 8 shows the overall layout of the TAD system 110. The construction of the TAD system 110 is generally similar to the TAD system 10 shown in FIG. 1, and only those elements which vary from those of the TAD system 10 will be described in detail.

The basic components of the TAD system 110 are a dryer assembly 112 through which a web 14 passes, a pump 16 for moving air through the system, such as a fan or a blower, and one or more heaters 18 which are connected by suitable air ducting to form a closed loop as shown. The dryer assembly 112 includes a generally cylindrical, hollow drum 122 rotatably supported and provided with means for turning it such as an electric motor. The surface of the drum 122 is air-permeable and may be of various constructions such as perforated sheet metal, honeycomb, expanded metal, etc. The dryer assembly 112 has a "machine direction" which refers generally to the overall direction of the movement of the web 14 through the TAD system 110 and would be from left to right in FIG. 8, for example. The dryer assembly 112 also has a "cross-machine direction" which refers to an axis perpendicular to the direction of movement through the TAD system 110, which in the illustrated example is parallel to the axis of rotation of the drum 122. The portion of the dryer assembly 112 where the web 14 enters is generally referred to as its "wet end" 126, while the portion where the web 14 exits is referred to as its "dry end" 128.

The drum 122 is partially surrounded by a supply hood 125. The exemplary supply hood 125 shown in FIG. 8 surrounds approximately 90° of the circumference of the drum 122, although this angle may be increased or decreased as required for a particular application. The supply hood 125 is described in more detail below.

The drum 122 is also partially surrounded by a return hood 130 disposed on the opposite side of the drum 122 from the supply hood 125. The exemplary return hood 30 shown in FIG. 8 surrounds approximately 200° of the circumference of the drum 122, although this angle may be increased or decreased as required for a particular application. The return hood 130 is a hollow housing comprising an impermeable outer wall 160 and a permeable inner wall 164 (see FIG. 11). In operation, the moisture-laden web 14 enters the dryer assembly 112 at the wet end 126, passes around the rotating drum 122, and exits the dryer assembly 112 at the dry end 128. The web 14 may be self supporting, but for typical paper or tissue applications, it is supported by a permeable fabric of a known type which functions in a manner similar to a conveyor belt, or simply a sleeve of a known type installed over the drum 122.

Heated drying air from one or more heaters 18 is supplied to the interior of the supply hood 125 through one or more air ducts 144 and 150. The heated air flows into the interior of the drum 122 and then through the web 14. The air passes into the return hood 130, which is maintained at a slightly negative pressure by virtue of its fluid communication with the intake side of the pump 16. The air then returns through the return duct 124 to the pump 16 where the cycle repeats. The principal difference between the TAD system 110 and the TAD system 10 is the fact that the air flow is reversed. That is, in the TAD system 110, the heated air is supplied from the supply hood 125 to the interior of the drum 122, and then passes from the drum's interior through the web 14 from the inside out.

Figure 10:
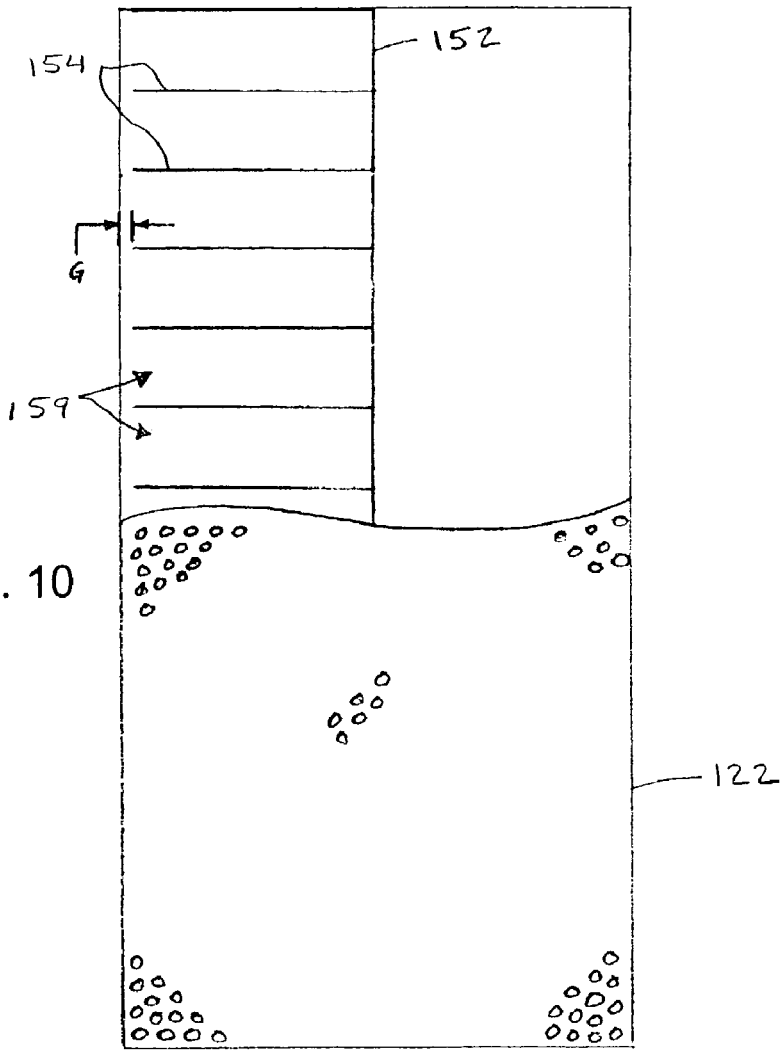
FIG. 10 is a top view of the drum of FIG. 9.
Figure 9:
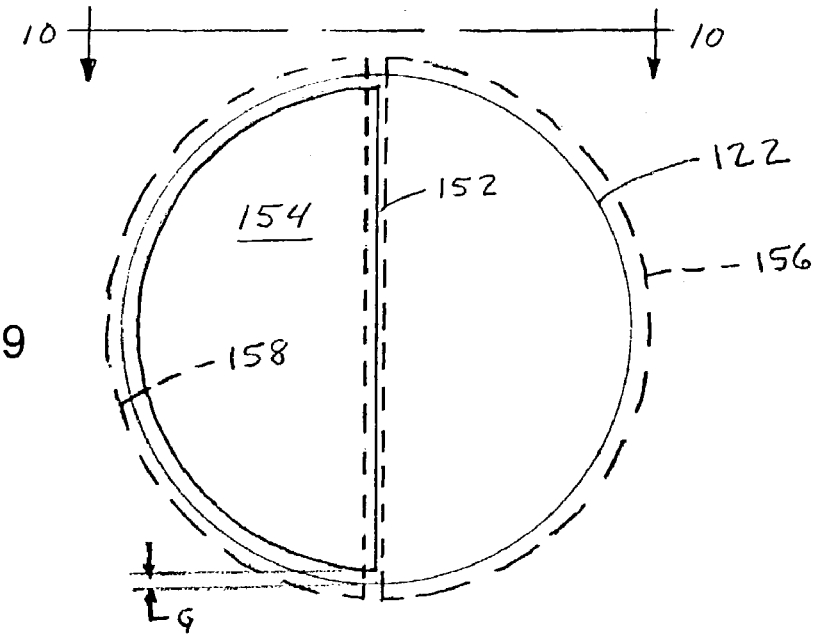
FIG. 9 is an end view of the drum of FIG. 8.

FIGS. 9 and 10 show the drum 122 in more detail. The drum 122 has an air-permeable surface and its basic construction is similar to that of drum 22. A splitter 152 is disposed in the interior of the drum 122. In the illustrated example the splitter 152 is shown positioned in the center of the drum 122 dividing it into two equal parts, but the splitter 152 could be placed off-center if desired to suit a particular application. A plurality of radially extending drum dividers 154 are attached to the splitter 152 (see FIG. 10). The splitter 152 and the dividers 154 are supported in a stationary position and do not rotate with the drum 122. The effect of the splitter 152 and the drum dividers 154 is to partition the air flow path through the interior of the drum 122 into a drying zone 156 which is open and a profiling zone 158 which is divided into a plurality of sections 159 in the cross-machine direction. It is noted that a gap, denoted "G" in FIGS. 9 and 10 is depicted between the edges of the splitter 152 and the drum dividers 154 and the interior surface of the drum 122. In practice the gap G would be made as small as possible to reduce air leakage while preventing unintentional contact and wear in operation. If desired, one or more seals of a known type (not shown) may be disposed between the drum 122 and the drum dividers 154 and splitter 152 to prevent leakage therebetween.

Figure 12:
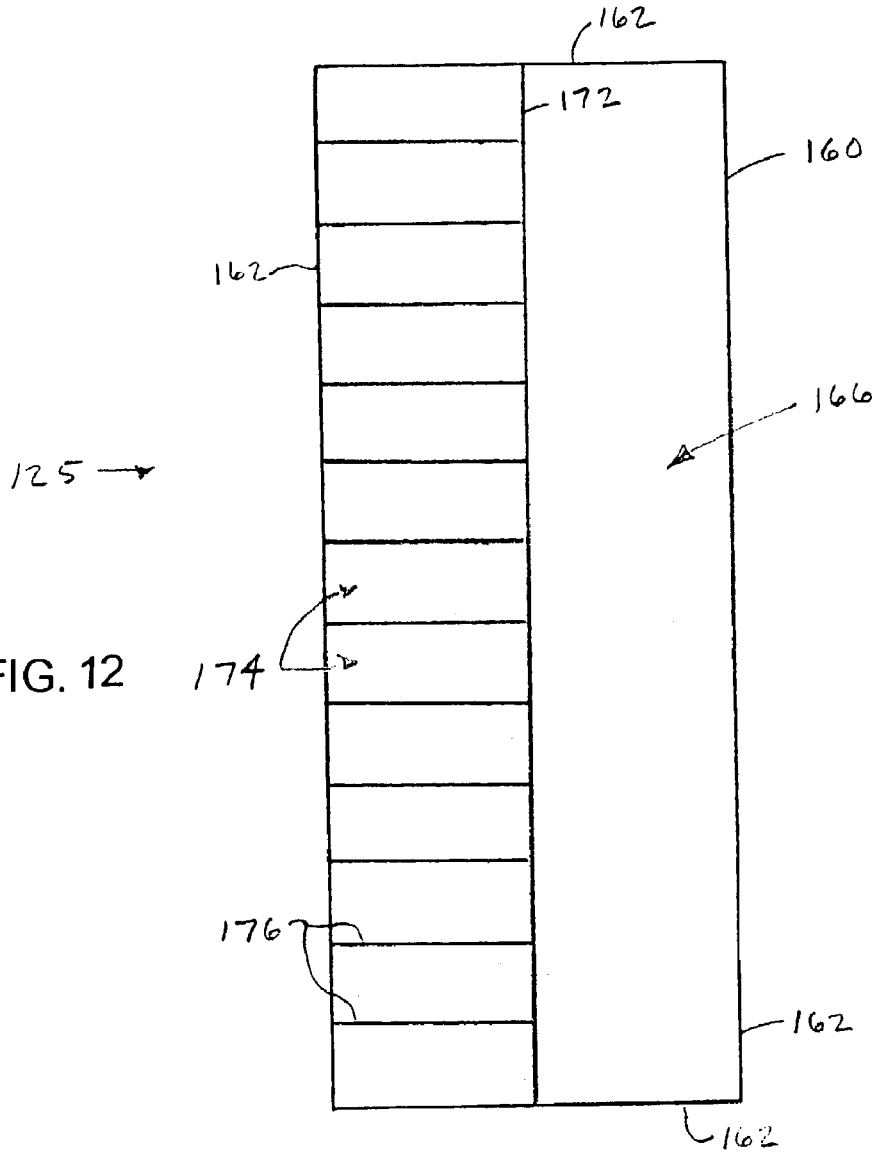
FIG. 12 is a top view of the supply hood of FIG. 11.
Figure 11:
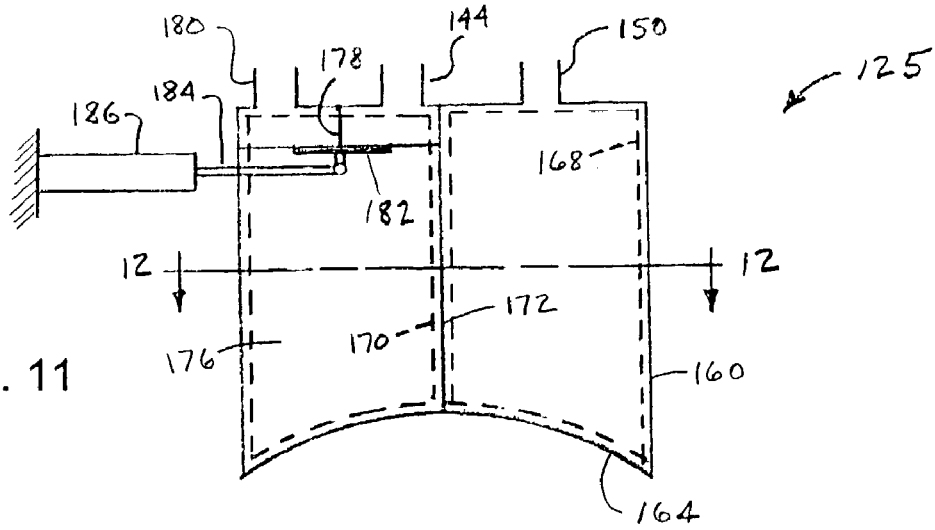
FIG. 11 is an end view of the supply hood of FIG. 8.

FIGS. 11 and 12 illustrate the supply hood 125 in more detail. The supply hood 125 has an outer wall 160, which may comprise several individual panels 162 connected together. The outer wall 160 is constructed of an impermeable material, for example sheet metal. The outer wall is spaced away from a permeable inner wall 164, such as a sheet metal plate having a plurality of perforations formed therethrough. The space between the outer wall 160 and the inner wall 164 surrounds an interior space 166. The inner wall 164 is curved to form a partial cylinder which surrounds the drum 122 and is disposed a small distance away from the surface of the drum 122. It is noted that the outer wall 164 is not strictly necessary and could be eliminated, so that the bottom of the supply hood 125 would simply be open between the sides of the outer wall 160.

A drying zone 168 is defined in the interior space 166 of the supply hood 125. As shown in FIG. 8, the drying zone 168 is part of an air flow circuit which starts at the pump 16, passes through a heater 18, is delivered to the supply hood 125 through a drying air duct 150, passes to the interior of the drum 122, through the web 14, into the return hood 130, and then returns to the pump 16 by way of the return duct 124.

The supply hood 125 incorporates a profiling zone 170. The profiling zone 170 is separated from the drying zone 168 by a divider 172 disposed in the supply hood 125. The profiling zone 170 is defined by a selected portion of the inner wall 164 and the portion of the interior space 166 of the supply hood 125 immediately adjacent the selected portion of the inner wall 164. In the illustrated example the outlet area of the profiling zone 170 extends over approximately one-half of the surface of the inner wall 164, although this dimension may be altered to suit a particular application. For example, if the profile is such that the cross-machine variation in moisture is large, then a larger profiling zone may be used to obtain a greater ability to change the moisture profile. The profiling zone 170 is divided into individual sections 174 (only one of which is shown in FIG. 11) by a plurality of spaced-apart divider plates 176 disposed in the interior space 166 of the supply hood 125 across the width of the supply hood 125, as shown in FIG. 12. Like the sections of the hood 30 of FIG. 1 described above, the individual sections 174 may be made arbitrarily small, limited only by the size of any ducting needed to deliver air to them. When the dryer assembly 112 is assembled, the individual profiling zone sections 174 of the supply hood 125 are aligned with corresponding ones of the profiling zone sections of the drum 122.

A supply of tempering air flow is supplied to the profiling zone 170 of the supply hood 125 by a tempering air duct 180 (see FIG. 8). In the example illustrated in FIG. 11, a septum 178 disposed in the supply hood 125 separates the air flows from the tempering air duct 180 and a drying air duct 144 (see FIG. 8). A plurality of moveable plates 182 (one of which is shown in FIG. 11) are disposed at the bottom of the septum 178. Each of the moveable plates 182 extends across the width of one of individual sections 174. The moveable plates 182 are able to slide between a first position wherein all of the air flow to the profiling zone 170 is supplied from the drying air duct 144 and no air from the tempering air duct 180 can reach the profiling zone 170 (i.e. all the way to the left in FIG. 11), and a second position wherein all of the air flow to the profiling zone 170 is supplied from the tempering air duct 180 and no air from the drying air duct 144 can reach the profiling zone 170 (i.e. all the way to the right in FIG. 11). The moveable plates 182 may be individually slid to any desired location between these two extreme positions to control the proportion of flows and therefore the temperature in each individual section 174 of the profiling zone 170. In the illustrated position the moveable plate 182 shown would allow approximately 50% tempering air flow and approximately 50% drying air flow into the profiling zone 170. Because all of the supply ducts 144, 150, and 180 are connected to the same closed circuit (see FIG. 8), the total airflow remains constant.

In the illustrated example the moveable plate 182 is shown as being connected to the rod 184 of a hydraulic cylinder 186 which supplied with working fluid through a known arrangement of pumps and valves (not shown) in order to position the moveable plate 182. Any other appropriate actuator means may be used, such as electric linear motors, ball screw jacks, etc. The moveable plates 182 may also be set in the desired position manually.

The air mixing arrangement is not limited to the sliding plate arrangement depicted in FIG. 11. Any type of valving arrangement which allows control of the relative flows of tempering air and drying air into the profiling zone 170 may be used.

Other methods of supplying air to the profiling zone 170 of the supply hood 125 may also be used. For example, an external valve and mixing plenum arrangement similar to that illustrated in FIG. 4 may be used to supply air to the profiling zone 170. In this case, no moving parts would be required inside the supply hood 125.

While the supply hood 125 has been illustrated having a single profiling zone 170 and a single drying zone 168, it is also possible to implement additional drying zones (not shown) by incorporating additional heaters and ducting to the TAD system 110 and by further partitioning the interior of the drum 122 and the supply hood 125. This would be accomplished in a manner similar to that described for the basic TAD system 10 described above.

While specific embodiments of the present invention have been described, it will be apparent to those skilled in the art that various modifications thereto can be made without departing from the spirit and scope of the invention as defined in the appended claims.

What is claimed is:

1. An apparatus for drying a traveling wet fibrous web, comprising:

a rotatable air-permeable drum, a hood at least partially surrounding said drum for receiving a flow of air and directing said flow towards an outer surface of said drum, at least a portion of said hood being divided into individual sections in a cross-machine direction of said hood;

means for supplying a flow of drying air having a first temperature to said hood; and means for supplying air at a selected temperature different from that of said drying air to at least one of said individual sections including means for mixing said flow of drying air and a flow of tempering air in a desired proportion and a plurality of profiling air ducts, each of said profiling air ducts connected to said mixing means and to one of said individual sections.

2. The apparatus of claim 1 wherein said means for supplying air at a selected temperature different from that of said drying air to at least one of said individual sections includes:

means for supplying a flow of tempering air at a second temperature to said hood; and means for selectively mixing said tempering air and said drying air within said hood.

3. The apparatus of claim 2 wherein said tempering air is colder than said heated air.

4. The apparatus of claim 2 wherein said tempering air is hotter than said heated air.

5. The apparatus of claim 1 wherein said hood is divided into at least two drying zones, wherein said drying air at said first temperature is provided to said first drying zone, and further including means for supplying a flow of drying air having a third temperature to said second drying zone.

6. The apparatus of claim 1 further comprising:

a sensor for generating a first signal indicative of the moisture content of said web;

a computer for receiving said first signal, and in response to said first signal, generating a second signal for controlling said means for supplying air to at least one of said individual sections.

7. An apparatus for drying a traveling wet fibrous web, comprising:

a rotatable air-permeable drum, at least a portion of the interior of said drum being divided into individual sections in a cross-machine direction of said drum;

a supply hood at least partially surrounding said drum for receiving a flow of air and directing said flow through a permeable outer surface of said drum, at least a portion of said hood being divided into individual sections in a cross-machine direction of said, said individual sections of said supply hood being aligned with corresponding ones of said individual sections of said drum;

means for supplying a flow of drying air having a first temperature to said supply hood; and means for supplying air at a selected temperature different from that of said drying air to at least one of said individual sections of said supply hood including means for mixing said flow of drying air and a flow of tempering air in a desired proportion; and a plurality of profiling air ducts, each of said profiling air ducts connected to said mixing means and to one of said individual sections.

8. The apparatus of claim 7 wherein said means for supplying air at a selected temperature different from that of said drying air to at least one of said individual sections further includes means for supplying said flow of tempering air at a second temperature to said supply hood.

9. The apparatus of claim 7 wherein said supply hood is divided into at least two drying zones, wherein said drying air at said first temperature is provided to said first drying zone, and further including means for supplying a flow of drying air having a third temperature to said second drying zone.

10. The apparatus of claim 7 further comprising:

a sensor for generating a first signal indicative of the moisture content of said web;

a computer for receiving said first signal, and in response to said first signal, generating a second signal for controlling said means for supplying air to at least one of said individual sections.

11. The apparatus of claim 7 wherein said tempering air is colder than said heated air.

12. The apparatus of claim 7 wherein said tempering air is hotter than said heated air.

13. An apparatus for drying a traveling wet fibrous web, said apparatus comprising:

a rotatable air-permeable drum;

a hood at least partially surrounding said drum, said hood including an impermeable outer wall spaced away from a permeable inner wall, said hood having a drying zone and a profiling zone, and a machine direction and a cross-machine direction, wherein said drying zone forms an open plenum in fluid communication with a first drying air duct and said permeable wall, and wherein said profiling zone is divided into individual sections along said cross-machine direction by a plurality of spaced-apart dividers disposed therein, each of said sections being in fluid communication with said permeable wall, said first drying air duct, and a tempering air duct; and means for controlling the proportion of air entering said profiling zone from said first drying duct and said tempering air duct.

14. The apparatus of claim 13 further comprising means for supplying air including means for supplying:

a flow of drying air at a first temperature to said hood; and a flow of tempering air at a second temperature to said hood.

15. The apparatus of claim 14 wherein said first temperature is less than said second temperature.

16. The apparatus of claim 14 wherein said first temperature is greater than said second temperature.

17. The apparatus of claim 14 further comprising:

a sensor for generating a first signal indicative of the moisture content of said web; and a computer for receiving said first signal, and in response to first signal, generating a second signal for controlling said means for supplying air.

* * * * *